United States Patent [19]

Duke et al.

[11] 4,351,619

[45] Sep. 28, 1982

[54] INK RIBBON CASSETTE

[75] Inventors: Douglas Duke, Brighton, England; Reinhold Drodofsky; Folker Galaske, both of Pforzheim, Fed. Rep. of Germany

[73] Assignee: International Standard Electric Corporation, New York, N.Y.

[21] Appl. No.: 211,228

[22] Filed: Nov. 28, 1980

[30] Foreign Application Priority Data

Nov. 29, 1979 [GB] United Kingdom ..... 7941277

[51] Int. Cl.[3] ..... B41J 33/10; B41J 32/02

[52] U.S. Cl. ..... 400/196.1; 400/208; 400/195; 400/234; 400/235.1

[58] Field of Search ..... 400/196, 196.1, 208, 400/209, 234, 250, 235, 235.1; 242/55.19 A, 197–199

[56] References Cited

U.S. PATENT DOCUMENTS

| | | | |
|---|---|---|---|
| 3,278,963 | 4/1966 | Dowd | 400/196 |
| 3,558,142 | 1/1971 | Poessel | 242/199 |
| 3,726,457 | 4/1973 | Staar | 242/55.19 A |
| 3,897,866 | 8/1975 | Mueller | 400/196.1 |
| 3,977,512 | 8/1976 | Teagarden et al. | 400/196.1 |
| 4,156,572 | 5/1979 | Carena | 400/196 |
| 4,265,550 | 5/1981 | Donnis et al. | 400/234 |
| 4,284,364 | 8/1981 | Rello | 400/234 |

FOREIGN PATENT DOCUMENTS

| | | | |
|---|---|---|---|
| 2208689 | 9/1972 | Fed. Rep. of Germany | 400/196 |
| 2136777 | 2/1973 | Fed. Rep. of Germany | 400/196.1 |
| 2810768 | 9/1977 | Fed. Rep. of Germany | 400/196.1 |
| 55-100184 | 7/1980 | Japan | 400/196.1 |
| 7706427 | 12/1977 | Netherlands | 400/196.1 |
| 2016411 | 9/1979 | United Kingdom | 400/196 |

*Primary Examiner*—William Pieprz

*Attorney, Agent, or Firm*—A. Donald Stolzy

[57] ABSTRACT

A continuous ink ribbon cassette for, for example, a serial printer in which a ribbon is kept in stacked loops in a vertical housing and is twisted on leaving and re-entering the housing so as to bring it into a vertical plan as it passes a print head. The ribbon leaves the housing through an opening at one end and passes round a vertical roller at the other end. After passing the print head, the ribbon is returned to the housing via a second vertical roller at the opposite end and an opening at the opposite end. The ribbon thus executes a figure 8 configuration and has the entire length of the housing in which to change its attitude from horizontal to vertical or from vertical to horizontal.

5 Claims, 6 Drawing Figures

INK RIBBON CASSETTE

BACKGROUND OF THE INVENTION

This invention relates to an endless ink ribbon cassette for a serial printer or the like.

PRIOR ART STATEMENT

In a known cassette, the deflection of a ribbon through 90 degrees is performed abruptly over a short length of ribbon by means of small diameter transport rollers. The resulting extra friction in the deflection area necessitates a greater driving force and produces excessive ribbon wear. There is in this prior arrangement no possibility of twisting the ribbon (once only) to produce a Mobius loop so as to render the wear of a ribbon having only one color uniform on both tracks. See also German Pat. No. 2,208,689 and British Pat. No. 2,016,411.

SUMMARY OF THE INVENTION

According to the invention, there is provided an endless ink ribbon cassette for a serial printer or the like comprising a rectangular housing in which the ribbon is stored and from which it emerges through respective openings at either end, the portion of the ribbon outside the housing passing along the walls of the housing, the ribbon passing directly to or from one of two opposite ends thereof so that the ribbon crosses itself in a figure 8 configuration over the length of the housing.

In accordance with another feature of the present invention, there is provided an endless ribbon cassette for a serial printer or the like comprising a housing extending across the printing width of a movable print head, and having its major portion disposed beneath the printing level and extending substantially vertically, the ribbon being stored for a time in the vertical portion from which it can be drawn out of at one end. The ribbon can then be turned to cause it to pass the print head in a substantially vertical plane before being turned to re-enter the housing at the other end thereof. At the said other end the ribbon enters the housing in a substantially horizontal plane. The ribbon, after being led out of one end of the housing, is then turned to the vertical position as it passes over the entire length of the housing and is returned to its horizontal position as it again passes over the entire length of the housing before re-entering the same, the ribbon thus following a figure 8 path between the ends of the housing.

One outstanding advantage of the present invention is that the ribbon is handled with great care.

By one additional twisting (Mobius loop) of the ink ribbon within the deflecting area, it is possible to achieve a changeover to an alternating use of tracks. Accordingly, only one type of cassette is required for both the normal two-track operation and the alternating track operation. The ribbon stowage space which reaches its full height within the area of the transport rollers, offers the possibility of accommodating more ribbon footage. Large transport rollers form long loops thus providing for an improved space utilization. The application of a transport roller drive from the bottom side makes it possible to dispense with a special spring mounting of the rollers and, in the case of a vertical insertion of the cassette, results in a reduced space requirement in the horizontal direction.

BRIEF DESCRIPTION OF THE DRAWINGS

In the accompanying drawings which illustrate exemplary embodiments of the present invention.

DESCRIPTION OF THE PREFERRED EMBODIMENTS

Figure 1:
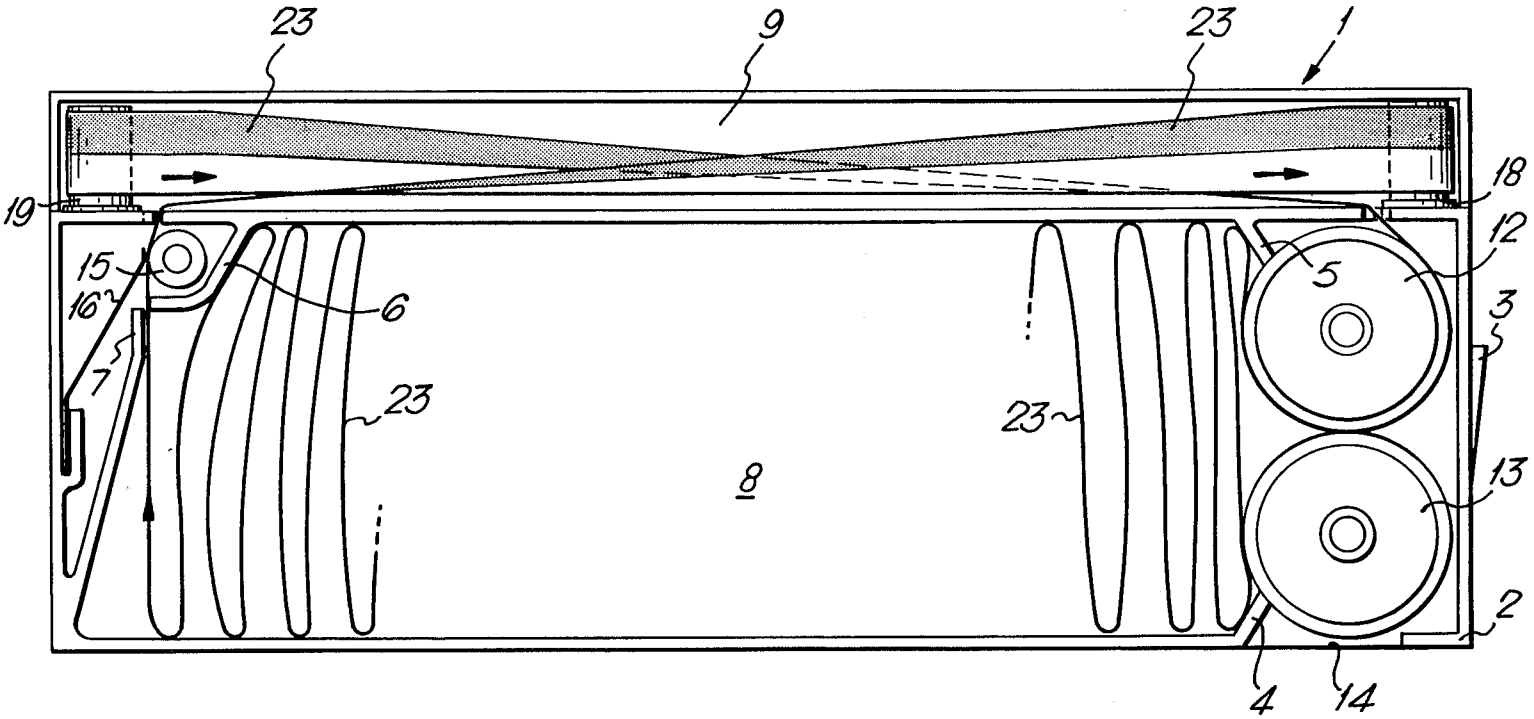
FIG. 1 is the rear elevational view of an ink ribbon cassette constructed in accordance with the present invention, the front cover being removed.

An endless ink ribbon cassette 1 is shown in FIG. 1. Cassette 1 is intended to be used in a vertical position. A cover surface 10 is shown in FIG. 3*a*. A housing 2 encloses a storage space 8 accommodating an endless ink ribbon 23 in large loops. This storage space 8 is bounded on one side by a pair of transport rollers 12 and 13 and, on the other side, by wall members 6 and 7. By being led between the pair of rollers 12 and 13, the ink ribbon is drawn in a known manner out of the storage space 8 between the wall members 6 and 7. The two spool or reel type transport rollers 12 and 13 both have the same diameter and are so dimensioned that together they almost fill the clear height of the interior space of the cassette. This assures that the ribbon is stored in large loops of the full internal height of the spaces 8.

Figure 3B:
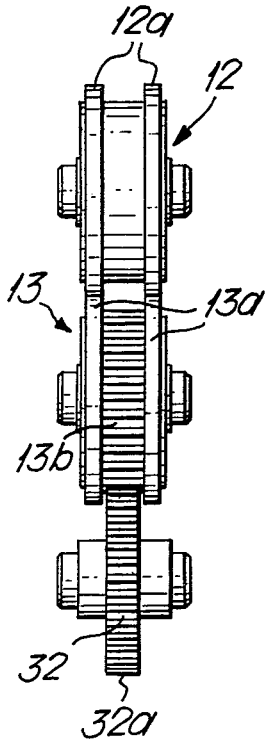
FIG. 3*b* is a side elevational view of portions of FIG. 3*a;*.
Figure 3A:
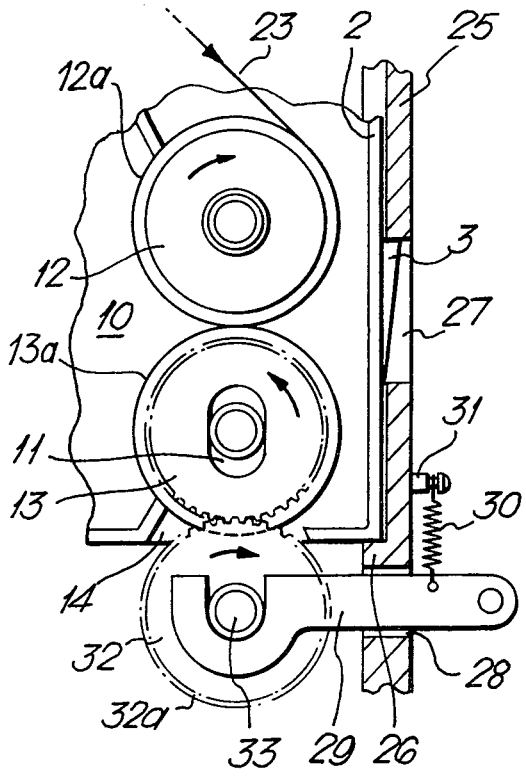
FIG. 3*a* is a broken away elevational view, partly in section, which shows the ink ribbon driving mechanism inside the cassette, the cassette being inserted in a holder and provided with a transparent cover surface.

As shown in FIGS. 3*a* and 3*b*, the transport rollers 12 and 13 are each provided over their circumferences with spaced rubber rings 12*a* and 13*a*, respectively. The upper roller 12 is supported in a freely rotatable manner on a fixed axis while the lower roller 13 is likewise supported in a freely rotatably manner but on a hub in elongated holes 11. One hole 11 is provided through surface 10 and the surface facing the same on the opposite side roller 13.

The lower transport roller 13 is provided with drive teeth 13*b* (FIG. 3*b*) between its rings 13*a*.

Figure 4:
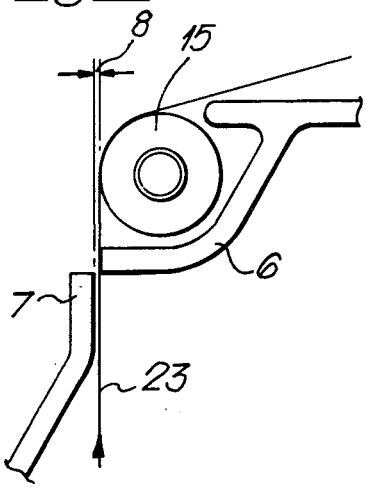
FIG. 4 is another broken away elevational view of the cassette.

Housing 3 is provided with a recess 14 in FIG. 3*a*. Rubber rings 12*a* and 13*a* are engaged by stripping fingers (guide members) 4 and 5 shown in FIG. 1 forming part of the cassette housing. Fingers 4 and 5 each form an obtuse angle of at least 135 degrees and are arranged in such a way in relation to one another as to provide for as large as possible a circumferential area of the transport rollers 12 and 13 on the side facing the stowage space. Fingers 4 and 5 serve to free the ribbon. The two members 6 and 7, as is shown in FIGS. 1 and 4, are positioned at right angles to one another. This leaves a narrow gap 8' (FIG. 4) between them. Gap 8' is somewhat larger than the thickness of the ink ribbon 23. The gap 8' is arranged in such a way that its extension is vertical and is tangent to roller 15. At this point a flat leaf spring 16 (FIG. 1) bears against ribbon 23.

Above the part of the cassette described hereinbefore, there is provided a separate space 9 which is, however, integrated into the housing 2, and extends throughout the entire length of the ink ribbon cassette 1.

The clear height of this space corresponds to the width of the ink ribbon 23. Towards the rear side as shown in FIG. 1, this space 9 is open, but is likewise covered up when the covering surface 10 (FIG. 3*a*) is placed in position. For insertion of the ink ribbon 23, the part of the housing enclosing the space 9, may be designed as a separate cover which, with the aid of snap-in means, is capable of being detachably connected to the lower part of the housing 2.

Figure 2A:
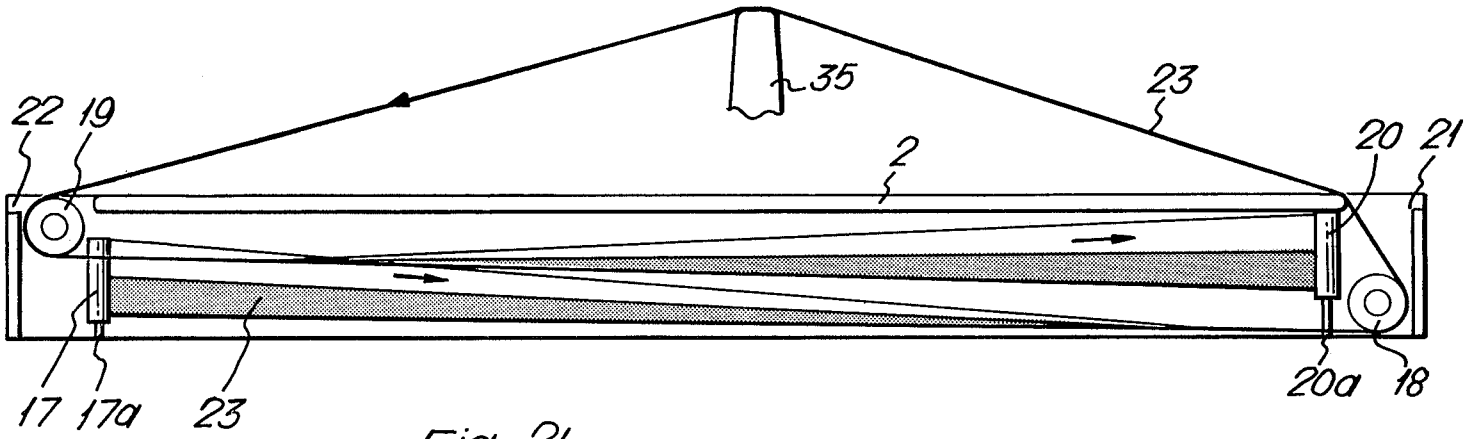
FIG. 2*a* is a top plan view of a cassette showing the ribbon path for an ink ribbon having two colors.

At the ends of the space 9 there are provided deflection pulleys 18 and 19 on vertical axes. Pulleys 18 and 19 are diagonally offset with respect to one another (FIG. 2*a*). Within the area of the guide pulleys 18 and 19 the cover plate of the space 9 towards the side of the print head 35 is provided with recesses 21 and 22. Through the two recesses 21 and 22 the ink ribbon 23 is led out of the ink ribbon cassette 1 and back into the housing 2 after having passed through a conventional external guide area. Closely in front of the two deflection guide pulleys 18 and 19, slot-like openings 17 and 20 (FIGS. 2*a* and 2*b*) are provided in the partition wall closing the stowage space positioned therebelow. These openings are offset in relation to their respective guide pulley and are accessible from the outside via slots 17*a* and 20*a* provided for in the cover surface. The openings 17 and 20 are those shown in FIG. 1 through which the ink ribbon 23 passes.

Owing to the vertical operating position of the ink ribbon cassette 1, the ink ribbon 23 leaves the stowage space 8 lying flat. Within the area of external guidance past the print head, however, the ink ribbon must stand up vertically. It is necessary, therefore, to deflect the ink ribbon by 90 degrees. With the ink ribbon cassette 1 described hereinbefore, this is carried out in a careful way throughout the entire length of the cassette housing 2 in that, as shown in FIG. 1, the ink ribbon 23 is guided via the roller 15 to the deflection guide pulley 18 and, in the course of this, is deflected through 90 degrees. From there the vertically standing ink ribbon 23, as shown in FIG. 2*a*, is led in the external guide area, past the print head 35 and, by being led over the guide pulley 19, is permitted to re-enter the cassette 1. As the ink ribbon 23 is led back to the slot-like opening 20 on the opposite side of the space 9, it is deflected again into the horizontal position and to the transport rollers 12 and 13. The guidance of the ink ribbon 23 as described hereinbefore makes it necessary for it to be led crosswisely within the area of the space 9 in a figure 8 pattern.

Whenever an ink ribbon having two colors is used, as is shown in FIG. 1 and FIG. 2*a*, it is necessary for the two printing tracks on the ribbon to maintain their relative positions at all times. Thus, for example, in the case of a black and red ink ribbon, the black printing track, if above, must always stay above and the red printing track must then always remain below. This is achieved by properly arranging the ink ribbon 23. Ink ribbon 23 is turned, in this case, in the clockwise direction, after having passed through the external guide area, and then is turned back in a counterclockwise direction.

Figure 2B:
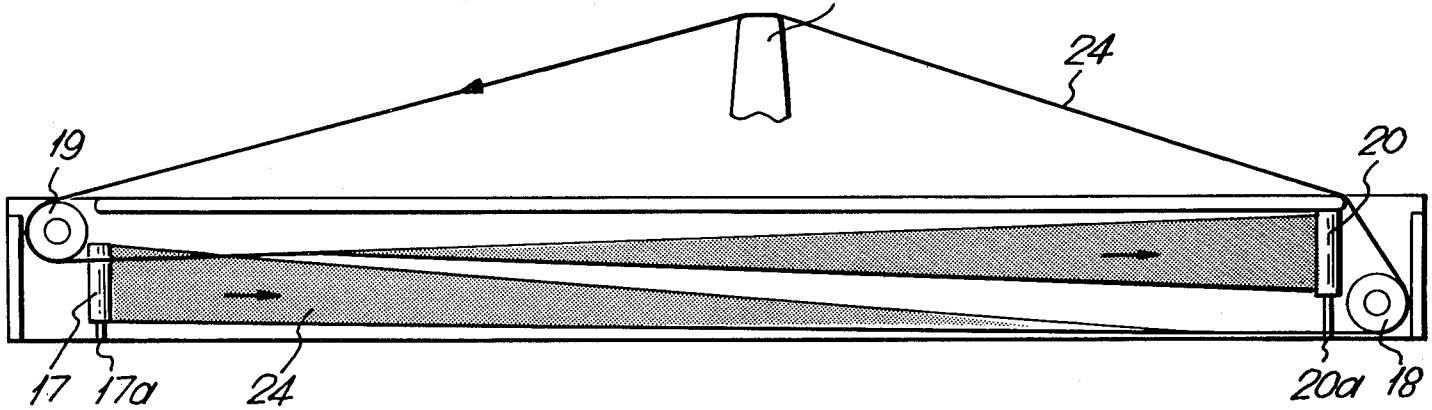
FIG. 2*b* is a top plan view of a cassette showing the ink ribbon path for an ink ribbon having one color.

This is different from the situation with a single color ink ribbon 24 as shown in FIG. 2*b*, where there is required an automatic changing of tracks (printing on both sides). In this case the ink ribbon 24 must be twisted in itself by 180 degrees, to form a Mobius loop. By simply taking this measure, there is achieved the automatic changing of tracks. No constructional modification of the cassette 1 is required. The additional 180 degree twist results from the 90 degrees which are required for straightening up the ink ribbon, and from the further 90 degrees in the same direction in the course of leading the ribbon back into the horizontal position. In this way, the ends of the ink ribbon 24 which are joined together with one end being twisted through 180 degrees before the joint is made (Mobius strip twist), are twisted by 180 degrees in relation to one another, thus providing for the automatic changing of tracks.

As already mentioned hereinbefore, driving of the transport rollers 12 and 13 when the ink ribbon cassette 1 has been inserted into a cassette holder 25, is effected with the aid of certain means. As is shown in FIG. 3*a*, these means consist of a rocking lever 29 pivotally mounted in the printer, extending through an opening 28 provided for in a lower part of the holder, and acted upon by a tension spring 30 suspended from a pin 31. This rocking lever 29 serves as the bearing for a shaft 33 which is the driving shaft of a small size motor (not shown) fixed to the rocking lever 29. On the free end of shaft 33 there is mounted a toothed driving wheel 32. The rocking lever 29 is arranged in such a way that the toothed driving wheel 32 is aligned with the teeth 13*b* of the transport roller 13 in the inserted state of an ink ribbon cassette 1 as shown in FIG. 3*b*. This state is shown in FIG. 3*a*. As soon as the bottom of the cassette 1 meets the limit stops 26, a locking spring 3 provided on the cassette itself engages in a corresponding snap lock opening 27 provided in the holder 25. In this position the toothed driving wheel 32 extends through the recess 14 provided in the housing 2 shown in FIG. 3*a*, and engages with its teeth 32*a* the teeth 13*b* of the lower transport roller 13. By the action of the tension spring 30 the lower transport roller 13 is pressed upwards against the upper transport roller 12. The force of the spring 30 is such that the transport rollers 12 and 13 and the rubber rings 12*a* and 13*a* thereof are pressed against one another. When the arrangement is driven in the direction as indicated by the arrows, the ink ribbon 23 is caused to move.

At the time when the ink ribbon is inserted in the cassette 1, there is no spring-loading on the transport rollers 12 and 13 and this facilitates loading of the ink ribbon.

What is claimed is:

1. An inked ribbon cassette comprising: an endless inked ribbon; a housing defining a first partial enclosure to hold said inked ribbon in a serpentine configuration with the ribbon surface having an elongated major dimension and a minor dimension perpendicular to said major dimension, said housing defining a second partial enclosure to hold said ribbon in place for use, said first and second partial enclosures being separated by a common wall, said housing having first and second parallel slots through, but at opposite ends of said common wall to permit said ribbon to exit from said first partial enclosure to said second partial enclosure and to enter said second partial enclosure from said first partial enclosure, said common wall being parallel to said ribbon surface minor dimension; first and second pulleys adjacent to said first and second slots, respectively, said first and second pulleys having respective parallel first and second axes perpendicular to the said common wall said ribbon exiting said first slot, and having a first portion twisting 90 degrees and extending around said second and first pulleys in succession in the same circumferential direction about each pulley and having a second portion twisting 90 degrees and passing through said second slot, said first and second twisting portions of said ribbon overlying each other and being spaced apart a distance very small in comparison to the distance between said axes; and means mounted in said housing to pull said ribbon through said second slot into said first parallel enclosure, said ribbon twisting portions forming said ribbon into a Mobius loop.

2. In a ribbon cassette for a serial printer or the like including a housing, a print head having a printing width, said housing extending across said printing width and having its major portion disposed beneath the printing level, said housing having a vertical portion, the combination comprising: an endless ribbon stored in said housing vertical portion, said ribbon being drawn out of a first end of said housing and turned so that it passes said print head in a substantially vertical plane before being turned to re-enter said housing at a second end of said housing in a substantially horizontal plane, said ribbon after being led out of one end of said housing, being turned to a vertical position as it passes over the entire length of the housing after leaving said housing and returning to a horizontal position as it again passes over the entire length of said housing before re-entering the same, said ribbon thus following a figure 8 path between the ends of said housing, said housing including first and second horizontal openings, said ribbon leaving said housing through said first horizontal opening at said first end of said housing, first and second pulleys, said ribbon passing around said first pulley on a vertical axis at said second end of said housing and returning to said housing through said second horizontal opening at said second end of said housing after passing around said second pulley at said first end of said housing said ribbon passing over said print head between said first and second pulleys, said housing vertical portion defining a storage space, first and second rollers being provided within said said storage space, said first and second pulleys being arranged in a substantially horizontal housing portion above said storage space, said ribbon being guided out of and into said horizontal housing portion by said first and second rollers, respectively, within said storage space adjacent said first and second openings, respectively, a third roller being provided, said ribbon passing between said second and third rollers by which it is drawn through said second opening and back into said storage space, said second and third rollers having combined diameters equal to the internal height of said storage space in order to cause said ribbon to be stored in a series of loops extending over the internal height of said storage space said second and third rollers having peripheral gripping rings to engage said ribbon said second roller having a fixed axis and said third roller having a movable axis permitting it to move away from said second roller for the insertion of said ribbon between said second and third rollers and towards said second roller under spring-pressure in order to grip the inserted ribbon, said third roller being provided with teeth accessible through an aperture in said housing such that when the cassette is loaded into the printer, a motor-driven gear wheel having teeth and carried on a spring-loaded lever of said printer is engaged with the teeth of said third roller, the spring-loading serving both to maintain the teeth of said gear wheel and of said third roller in engagement and to press said second and third rollers together to grip the ribbon.

3. An endless ink ribbon cassette as claimed in claim 2 characterized in that two fixed members are provided, said first roller adjacent said first horizontal opening being immediately preceded, in the direction of ribbon travel, by a gap between said two fixed members, said gap being of a size to allow the passage of a single thickness of ribbon but not a loop thereof, and means to supply spring-like pressure to said ribbon against said second roller.

4. An endless ink ribbon cassette as claimed in claim 3 characterized in that the ribbon is given an extra twist during its passage from said first horizontal opening to said second horizontal opening to form a Mobius loop.

5. An endless ink ribbon cassette as claimed in claim 2 characterized in that the ribbon is given an extra twist during its passage from said first horizontal opening to said second horizontal opening to form a Mobius loop.

* * * * *